US010474073B2

(12) United States Patent
Huang et al.

(10) Patent No.: US 10,474,073 B2
(45) Date of Patent: Nov. 12, 2019

(54) FUSING DEVICE ADAPTED FOR FUSING TONERS ON A PRINTING MEDIA AND PRINTING APPARATUS THEREWITH

(71) Applicant: AVISION INC., Hsinchu (TW)

(72) Inventors: Min-Tung Huang, Hsinchu (TW); Chia-Hsin Lin, Hsinchu (TW); Jan-Hsing Kao, Miaoli County (TW)

(73) Assignee: AVISION INC., Hsinchu (TW)

( * ) Notice: Subject to any disclaimer, the term of this patent is extended or adjusted under 35 U.S.C. 154(b) by 0 days.

(21) Appl. No.: 16/121,655

(22) Filed: Sep. 5, 2018

(65) Prior Publication Data

US 2019/0121269 A1 Apr. 25, 2019

(30) Foreign Application Priority Data

Oct. 25, 2017 (TW) ..... 106136635 A

(51) Int. Cl.
*G03G 15/20* (2006.01)
*G03G 15/16* (2006.01)

(52) U.S. Cl.
CPC ..... *G03G 15/2046* (2013.01); *G03G 15/167* (2013.01); *G03G 15/206* (2013.01); *G03G 15/2017* (2013.01); *G03G 15/2053* (2013.01); *G03G 2215/2003* (2013.01); *G03G 2215/2035* (2013.01)

(58) Field of Classification Search
CPC ..... G03G 15/2046; G03G 15/167; G03G 15/2017; G03G 15/2053; G03G 15/206; G03G 2215/2003; G03G 2215/2035
See application file for complete search history.

(56) References Cited

U.S. PATENT DOCUMENTS 6,559,421 B1 5/2003 Yura
2010/0322681 A1 12/2010 Kikuchi
2011/0058864 A1* 3/2011 Fujimoto ..... G03G 15/2007 399/329

(Continued)

FOREIGN PATENT DOCUMENTS

JP S62-178289 A 8/1987
TW 200834269 8/2008

*Primary Examiner* — Ryan D Walsh
(74) *Attorney, Agent, or Firm* — Winston Hsu

(57) ABSTRACT

A fusing device includes a driving roller and a fusing unit including a heat insulating component, a heat generating component, a heat conducting component connected to the heat insulating component, a heat reflecting component, a metal reinforcing component and a fusing component. The heat generating component and the heat reflecting component are located inside the heat insulating component. The metal reinforcing component is located outside the heat insulating component and separated from the heat conducting component. The fusing component movably surrounds the heat conducting component, the heat insulating component and the metal reinforcing component. The heat reflecting component reflects heat generated from the heat generating component to the heat conducting component. The heat conducting component conducts the heat to the fusing component. The fusing component contacts with a printing media to fuse toners onto the printing media by heating when the driving roller drives the printing media to move.

18 Claims, 3 Drawing Sheets

(56) References Cited

U.S. PATENT DOCUMENTS

2011/0150543 A1* 6/2011 Fujiwara ..... G03G 15/2053 399/329
2011/0150544 A1* 6/2011 Ishida ..... G03G 15/2039 399/329
2011/0158715 A1* 6/2011 Suzuki ..... G03G 15/2053 399/329
2011/0158716 A1* 6/2011 Fujiwara ..... G03G 15/2053 399/329
2011/0158717 A1* 6/2011 Suzuki ..... G03G 15/2007 399/329
2011/0158718 A1* 6/2011 Fujiwara ..... G03G 15/2007 399/329
2011/0158719 A1* 6/2011 Miyauchi ..... G03G 15/2007 399/329
2011/0164905 A1* 7/2011 Kondo ..... G03G 15/2053 399/328
2011/0164906 A1* 7/2011 Ishida ..... G03G 15/2007 399/329
2011/0170919 A1* 7/2011 Fujiwara ..... G03G 15/2064 399/331
2011/0170920 A1* 7/2011 Fujiwara ..... G03G 15/2064 399/331
2011/0188908 A1* 8/2011 Ishida ..... G03G 15/20 399/330
2011/0206406 A1* 8/2011 Suzuki ..... G03G 15/2064 399/90
2011/0206409 A1* 8/2011 Kondo ..... G03G 15/2017 399/92
2011/0211881 A1* 9/2011 Suzuki ..... G03G 15/2053 399/329
2011/0211882 A1* 9/2011 Suzuki ..... G03G 15/2053 399/329
2011/0236088 A1* 9/2011 Maruyama ..... G03G 15/2064 399/329
2011/0318074 A1* 12/2011 Hiramatsu ..... G03G 15/2007 399/329
2012/0008971 A1* 1/2012 Lee ..... G03G 15/2064 399/69
2012/0051809 A1* 3/2012 Miyauchi ..... G03G 15/2064 399/329
2012/0163883 A1* 6/2012 Tsukawaki ..... G03G 15/2064 399/329
2012/0163884 A1* 6/2012 Kondo ..... G03G 15/2064 399/329
2012/0163885 A1* 6/2012 Ishida ..... G03G 15/2053 399/329
2012/0163886 A1* 6/2012 Suzuki ..... G03G 15/2053 399/329
2012/0163889 A1* 6/2012 Koyama ..... G03G 15/2053 399/339
2012/0219324 A1* 8/2012 Masuda ..... G03G 15/2032 399/122
2012/0251138 A1* 10/2012 Ishida ..... G03G 15/2053 399/33
2012/0251207 A1* 10/2012 Ishida ..... G03G 15/2039 399/329
2012/0275830 A1* 11/2012 Suzuki ..... G03G 15/2025 399/329
2012/0275831 A1* 11/2012 Ishida ..... G03G 15/2053 399/329
2012/0275832 A1* 11/2012 Suzuki ..... G03G 15/2025 399/329
2012/0275833 A1* 11/2012 Ishida ..... G03G 15/2053 399/329
2012/0308276 A1* 12/2012 Miyauchi ..... G03G 15/2017 399/329
2012/0308277 A1* 12/2012 Suzuki ..... G03G 15/2053 399/329
2013/0071155 A1* 3/2013 Suzuki ..... G03G 15/2064 399/329
2013/0071156 A1* 3/2013 Suzuki ..... G03G 15/2053 399/329
2013/0071157 A1* 3/2013 Suzuki ..... G03G 15/2053 399/329
2013/0071158 A1* 3/2013 Suzuki ..... G03G 15/2053 399/329
2013/0071159 A1* 3/2013 Suzuki ..... G03G 15/2053 399/329
2013/0084111 A1* 4/2013 Iwata ..... G03G 15/2053 399/329
2013/0136511 A1* 5/2013 Suzuki ..... G03G 15/2035 399/329
2013/0136512 A1* 5/2013 Suzuki ..... G03G 15/2053 399/329
2013/0136513 A1* 5/2013 Suzuki ..... G03G 15/2053 399/329
2013/0136514 A1* 5/2013 Suzuki ..... G03G 15/2007 399/329
2013/0195523 A1* 8/2013 Yamaji ..... G03G 15/2053 399/329
2013/0195527 A1* 8/2013 Suzuki ..... G03G 15/2053 399/329
2013/0322937 A1* 12/2013 Suzuki ..... G03G 15/2003 399/329
2013/0322939 A1* 12/2013 Ishida ..... G03G 15/2053 399/329
2014/0086648 A1* 3/2014 Maruyama ..... G03G 15/2053 399/329
2014/0086649 A1* 3/2014 Hazeyama ..... G03G 15/2053 399/329
2014/0294459 A1* 10/2014 Kondo ..... G03G 15/206 399/329
2014/0294460 A1* 10/2014 Kondo ..... G03G 15/206 399/329
2014/0294462 A1* 10/2014 Murodate ..... G03G 15/2053 399/329
2014/0294463 A1* 10/2014 Iwata ..... G03G 15/2053 399/329
2014/0294464 A1* 10/2014 Maruyama ..... G03G 15/2053 399/329
2014/0294465 A1* 10/2014 Hazeyama ..... G03G 15/2017 399/329
2015/0093159 A1* 4/2015 Matsuno ..... G03G 21/1647 399/322
2015/0093162 A1* 4/2015 Ishida ..... G03G 15/2053 399/328
2015/0093165 A1* 4/2015 Kondo ..... G03G 15/206 399/329
2015/0093166 A1* 4/2015 Ishida ..... G03G 15/2053 399/329
2015/0093167 A1* 4/2015 Hazeyama ..... G03G 15/2053 399/329
2015/0093168 A1* 4/2015 Hiramatsu ..... G03G 15/2053 399/329
2015/0277306 A1* 10/2015 Kondo ..... G03G 15/2039 399/33
2015/0277311 A1* 10/2015 Iwata ..... G03G 15/2042 399/329
2015/0277315 A1* 10/2015 Maruyama ..... G03G 15/2053 399/329
2015/0277318 A1* 10/2015 Hazeyama ..... G03G 15/2028 399/329
2016/0231674 A1* 8/2016 Ishida ..... G03G 15/2053
2016/0231676 A1* 8/2016 Ishida ..... G03G 15/2053
2016/0231677 A1* 8/2016 Ishida ..... G03G 15/2053
2016/0252855 A1* 9/2016 Ishida ..... G03G 15/2053 399/329
2017/0031277 A1* 2/2017 Handa ..... G03G 15/2053
2017/0031279 A1* 2/2017 Koyama ..... G03G 15/2046
2017/0090367 A1* 3/2017 Kajita ..... G03G 15/2053
2017/0285540 A1* 10/2017 Koyama ..... G03G 15/2053
2017/0343940 A1* 11/2017 Suzuki ..... G03G 15/2028
2018/0356754 A1* 12/2018 Yoshinaga ..... G03G 15/2064
2019/0121270 A1* 4/2019 Huang ..... G03G 15/2053

* cited by examiner

FUSING DEVICE ADAPTED FOR FUSING TONERS ON A PRINTING MEDIA AND PRINTING APPARATUS THEREWITH

BACKGROUND OF THE DISCLOSURE

1. Field of the Disclosure

The present disclosure relates to a fusing device and a printing apparatus therewith, and more particularly, to a fusing device capable of reducing heat loss and a printing apparatus therewith.

2. Description of the Prior Art

Laser printers and copy machines usually utilize a photosensitive drum to transfer toners on a printing media, such as paper. In order to make sure that the toners can be attached on the printing media stably, laser printers and copy machines usually further utilize a fusing device to fuse the toners onto the printing media by heating and pressing, which achieves an enhanced printing effect. However, in the prior art, a metal structure of the fusing device, which is used for reinforcing structural strength, is connected to the heating metal plate directly. Metal has excellent heat conductivity, which may lead to great heat loss. Therefore, in order to compensate the heat loss, the fusing device has to generate more heat continuously. It causes high electricity consumption. Furthermore, when the great heat loss occurs, the toners may not be fused completely, so that the toner cannot be attached onto the printing media stably, which reduces printing quality.

SUMMARY OF THE DISCLOSURE

Therefore, an objective of the present disclosure is to provide a fusing device capable of reducing heat loss and a printing apparatus therewith.

In order to achieve the aforementioned objective, the present disclosure discloses a fusing device adapted for fusing toners onto a printing media. The fusing device includes a driving roller and a fusing unit. The driving roller is for driving the printing media to move along a moving direction. The fusing unit includes a heat insulating component, a heat generating component, a heat conducting component, a heat reflecting component, a metal reinforcing component and a fusing component. An accommodating space is formed in the heat insulating component. An opening is formed on a side of the heat insulating component near the driving roller and communicated with the accommodating space. The heat generating component is located inside the accommodating space and for generating heat. The heat conducting component is connected to the heat insulating component and covers the opening. The heat reflecting component is connected to the heat insulating component. The heat reflecting component is located inside the accommodating space and on a side of the heat generating component away from the heat conducting component for reflecting the heat generated by the heat generating component to the heat conducting component. The metal reinforcing component is installed on an outer side of the heat insulating component. A stiffness of the metal reinforcing component is greater than a stiffness of the heat insulating component. The fusing component movably encloses the heat conducting component, the heat insulating component and the metal reinforcing component. The heat conducting component conducts the heat to the fusing component, and the fusing component contacts with the printing media to fuse the toners onto the printing media by heating when the driving roller drives the printing media to move along the moving direction.

According to an embodiment of the present disclosure, the heat conducting component and the metal reinforcing component are separated from each other.

According to an embodiment of the present disclosure, the metal reinforcing component is disposed on a side of the heat insulating component away from the driving roller.

According to an embodiment of the present disclosure, a cross section of the metal reinforcing component is substantially formed in a U shape, and two sides of the metal reinforcing component are fixed on the side of the heat insulating component away from the driving roller.

According to an embodiment of the present disclosure, the heat reflecting component and the heat conducting component are separated from each other.

According to an embodiment of the present disclosure, a cross section of the heat insulating component is substantially formed in a U shape. A first step-shaped structure is formed on a side of the heat insulating component near the opening. The first step-shaped structure includes a first disposing surface and a second disposing surface, and a side of the heat conducting component and a side of the heat reflecting component are connected to the first disposing surface and the second disposing surface respectively and do not contact with each other.

According to an embodiment of the present disclosure, a second step-shaped structure is formed on another side of the heat insulating component near the opening. The second step-shaped structure includes a third disposing surface and a fourth disposing surface, and another side of the heat conducting component and another side of the heat reflecting component are connected to the third disposing surface and the fourth disposing surface respectively and do not contact with each other.

According to an embodiment of the present disclosure, the heat reflecting component is a bent mirror aluminum plate.

According to an embodiment of the present disclosure, the heat insulating component is made of heat resistant plastic.

In order to achieve the aforementioned objective, the present disclosure further discloses a printing apparatus including a toner cartridge, a photoconductive drum and a fusing device. The toner cartridge stores toners. The photoconductive drum is for transferring the toners from the toner cartridge to a printing media. The fusing device is for fusing the toners onto the printing media. The fusing device includes a driving roller and a fusing unit. The driving roller is for driving the printing media to move along a moving direction. The fusing unit includes a heat insulating component, a heat generating component, a heat conducting component, a heat reflecting component, a metal reinforcing component and a fusing component. An accommodating space is formed in the heat insulating component. An opening is formed on a side of the heat insulating component near the driving roller and communicated with the accommodating space. The heat generating component is located inside the accommodating space and for generating heat. The heat conducting component is connected to the heat insulating component and covers the opening. The heat reflecting component is connected to the heat insulating component. The heat reflecting component is located inside the accommodating space and on a side of the heat generating component away from the heat conducting component for reflecting the heat generated by the heat generating component to the heat conducting component. The metal reinforcing component is installed on an outer side of the heat insulating component. A stiffness of the metal reinforcing component is greater than a stiffness of the heat insulating component. The fusing component movably encloses the heat conducting component, the heat insulating component and the metal reinforcing component. The heat conducting component conducts the heat to the fusing component, and the fusing component contacts with the printing media to fuse the toners onto the printing media by heating when the driving roller drives the printing media to move along the moving direction.

In summary, the present disclosure utilizes the heat insulating component for isolating the heat conducting component, the heat reflecting component and the metal reinforcing component. Furthermore, the metal reinforcing component with the greater stiffness is installed on the outer side of the heat insulating component. In such a way, it prevents the heat from transferring from the heat conducting component to the heat reflecting component or the metal reinforcing component, which reduces heat loss effectively and maintains temperature. Therefore, the fusing device can achieve a purpose of reducing electricity consumption and enhancing printing quality.

These and other objectives of the present disclosure will no doubt become obvious to those of ordinary skill in the art after reading the following detailed description of the preferred embodiment that is illustrated in the various figures and drawings.

DETAILED DESCRIPTION

Figure 1:
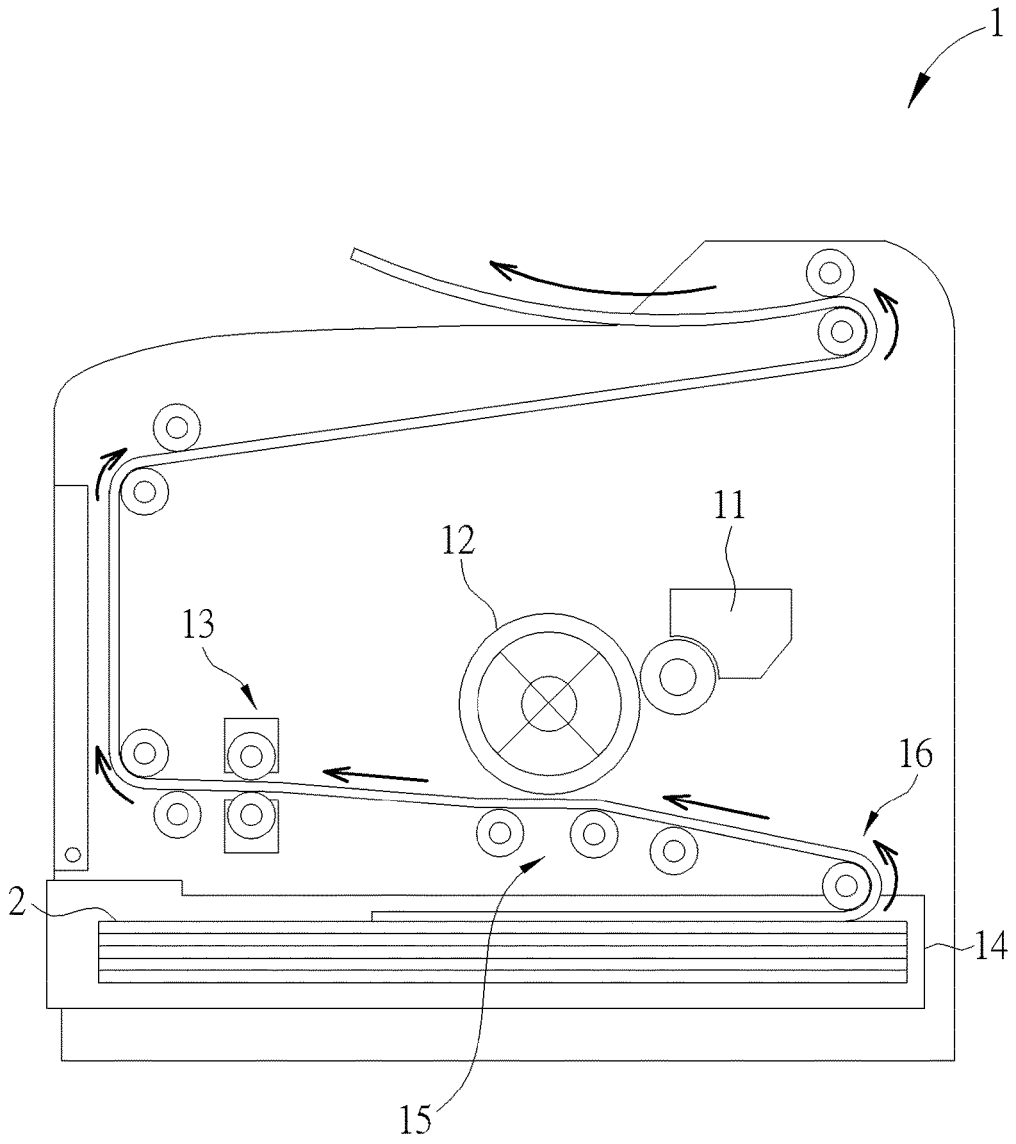
FIG. 1 is an internal structural diagram of a printing apparatus according to an embodiment of the present disclosure.
Figure 2:
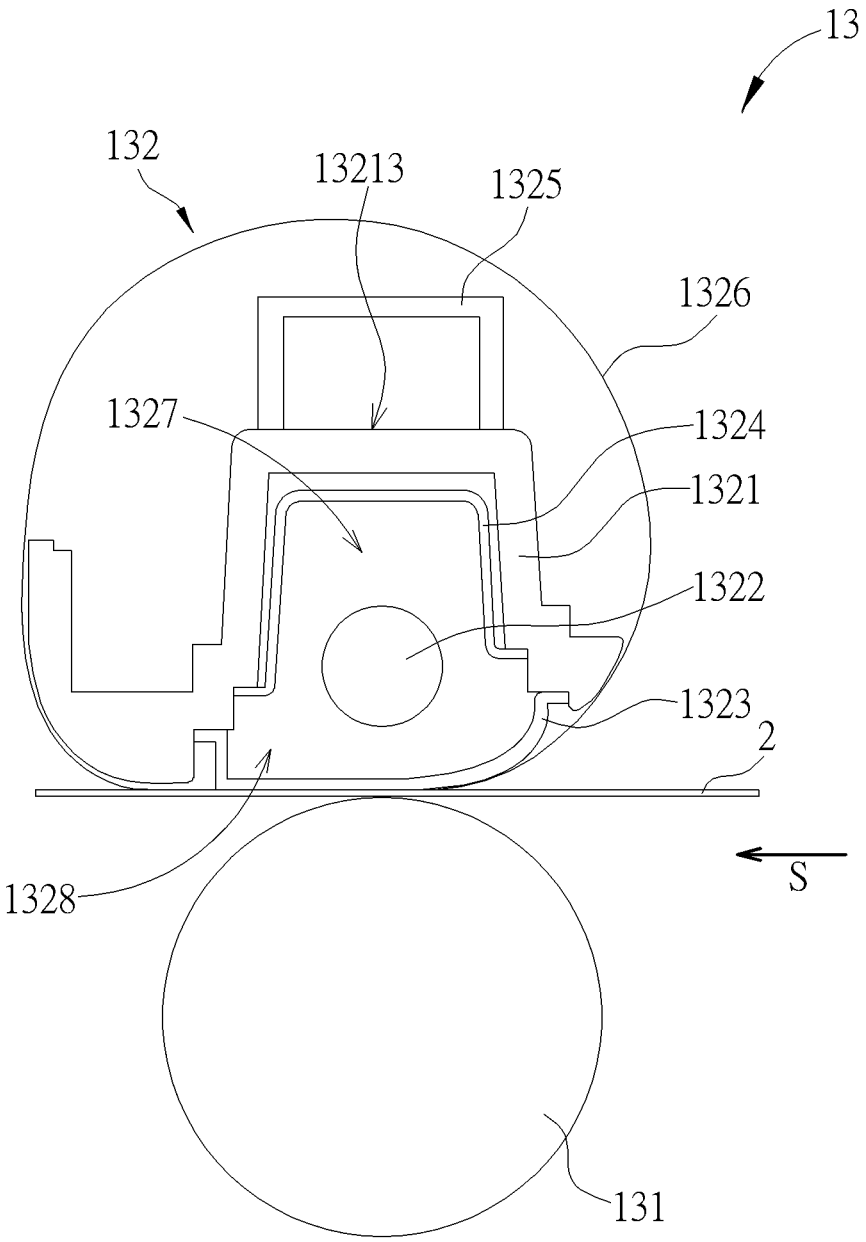
FIG. 2 is a diagram of a fusing device according to the embodiment of the present disclosure.

Please refer to FIG. 1 and FIG. 2. FIG. 1 is an internal structural diagram of a printing apparatus 1 according to an embodiment of the present disclosure. FIG. 2 is a diagram of a fusing device 13 according to the embodiment of the present disclosure. As shown in FIG. 1 and FIG. 2, in this embodiment, the printing apparatus 1 can be a copy machine or a printer and include a toner cartridge 11, a photoconductive drum 12, the fusing device 13, a paper tray 14, a driving module 15 and a feeding passage 16. The toner cartridge 11 stores toners, which are not shown in figures. The paper tray 14 receives at least one printing media 2, such as printing paper. The driving module 15 is for driving the printing media 2 to move from the paper tray 14 along the feeding passage 16 to pass through the photoconductive drum 12 and the fusing device 13. The photoconductive drum 12 is for transferring the toners from the toner cartridge 11 to the printing media 2. The fusing device 13 is for fusing the toners onto the printing media 2.

Figure 3:
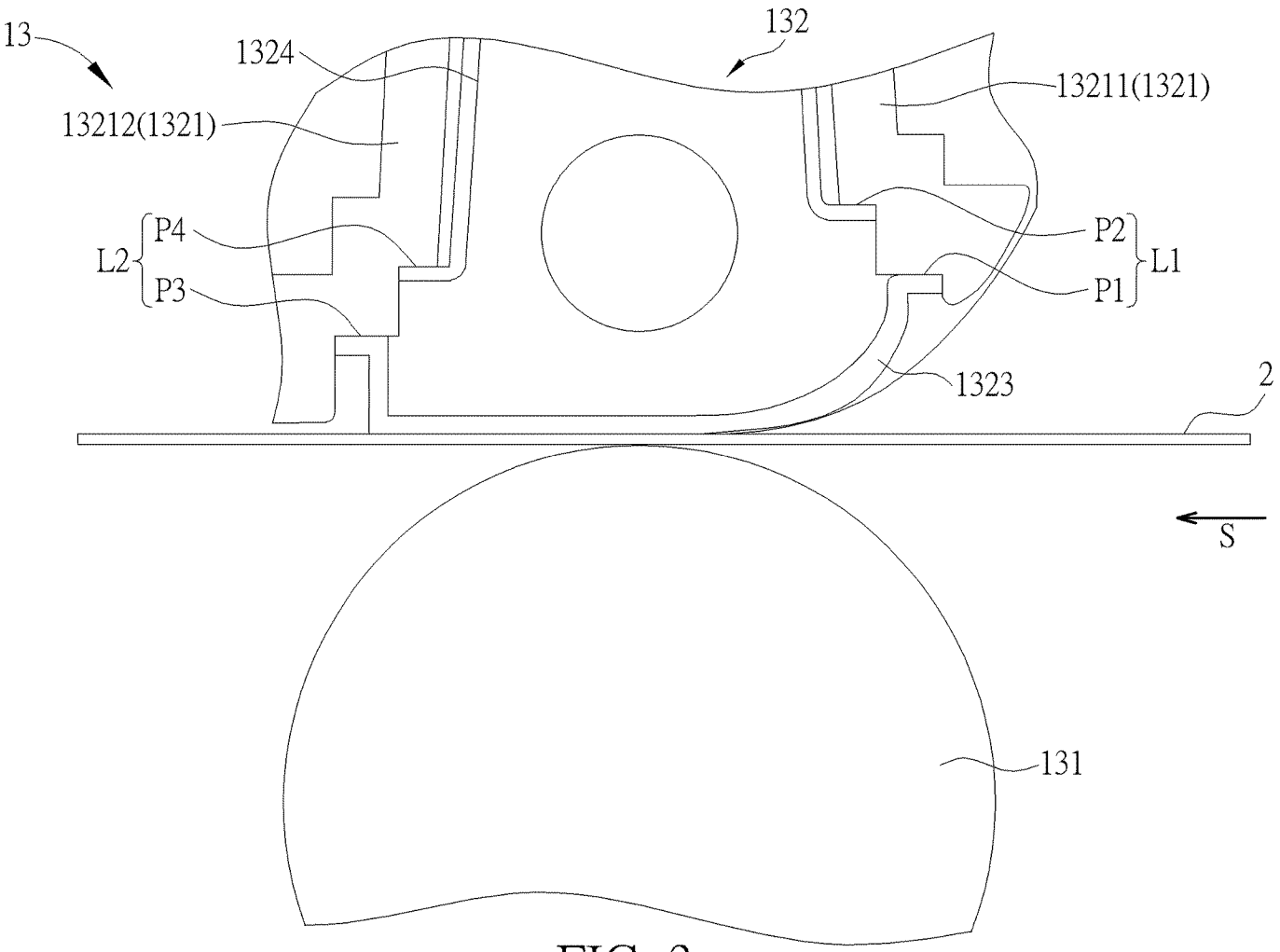
FIG. 3 is a partial enlarged diagram of the fusing device according to the embodiment of the present disclosure.

Please refer to FIG. 2 and FIG. 3. FIG. 3 is a partial enlarged diagram of the fusing device 13 according to the embodiment of the present disclosure. As shown in FIG. 2 and FIG. 3, the fusing device 13 includes a driving roller 131 and a fusing unit 132. The driving roller 131 is for driving the printing media 2 to move along a moving direction S. The fusing unit 132 includes a heat insulating component 1321, a heat generating component 1322, a heat conducting component 1323, a heat reflecting component 1324, a metal reinforcing component 1325 and a fusing component 1326. An accommodating space 1327 is formed inside the heat insulating component 1321. An opening 1328 is formed on a side of the heat insulating component 1321 near the driving roller 131 and communicated with the accommodating space 1327. The heat generating component 1322 is located inside the accommodating space 1327 and for generating heat. The heat conducting component 1323 is connected to the heat insulating component 1321 and covers the opening 1328. The heat reflecting component 1324 is connected to the heat insulating component 1321. The heat reflecting component 1324 is located inside the accommodating space 1327 and on a side of the heat generating component 1322 away from the heat conducting component 1323 for reflecting the heat generated by the heat generating component 1322 to the heat conducting component 1323.

The metal reinforcing component 1325 is installed on an outer side of the heat insulating component 1321 and separated from the heat conducting component 1323. A stiffness of the metal reinforcing component 1325 can be greater than a stiffness of the heat insulating component 1321 for increasing structural strength of the fusing unit 132, which prevents structural failure of the fusing unit 132 caused by the driving roller 131. In this embodiment, the metal reinforcing component 1325 can be installed onto the outer side of the heat insulating component 1321 by fasteners. The fusing component 1326 movably encloses the heat conducting component 1323, the heat insulating component 1321 and the metal reinforcing component 1325. In this embodiment, the fusing component 1326 can be a fusing belt or a fusing film. The heat insulating component 1321 and the metal reinforcing component 1325 together support the fusing component 1326 for maintaining a shape of the fusing component 1326. The heat conducting component 1323 conducts the heat to the fusing component 1326, and the fusing component 1326 contacts with the printing media 2 to fuse the toners onto the printing media 2 by heating when the driving roller 131 drives the printing media 2 to move along the moving direction S.

In this embodiment, preferably, a cross section of the heat insulating component 1321 can be substantially formed in a U shape. A first step-shaped structure L1 is formed on a side of the heat insulating component 1321 near the opening 1328. The first step-shaped structure L1 includes a first disposing surface P1 and a second disposing surface P2. A second step-shaped structure L2 is formed on another side of the heat insulating component 1321 near the opening 1328. The second step-shaped structure L2 includes a third disposing surface P3 and a fourth disposing surface P4. Two sides of the heat conducting component 1323 are connected to the first disposing surface P1 and the third disposing surface P3 respectively. Two sides of the heat reflecting component 1324 are connected to the second disposing surface P2 and the fourth disposing surface P4 respectively. In other words, by arrangement of the first step-shaped structure L1 and the second step-shaped structure L2, the heat conducting component 1323 and the heat reflecting component 1324 can be separated from each other. In such a way, it prevents the heat from transferring from the heat conducting component 1323 to the heat reflecting component 1324, which reduces heat loss. Furthermore, in order to increase the structural strength of the fusing unit 132, preferably, a cross section of the metal reinforcing component 1325 can be substantially formed in a U shape. Two sides of the metal reinforcing component 1325 can be fixed on a side 13213 of the heat insulating component 1321 away from the driving roller 131. That is, the metal reinforcing component 1325 and the heat conducting component 1323 are located at two opposite sides of the heat insulating component 1321 and separated from each other. In such a way, it prevents the heat from transferring from the heat conducting component 1323 to the metal reinforcing component 1325, which reduces heat loss, too. Besides, in this embodiment, preferably, the heat reflecting component 1324 can be a bent mirror aluminum plate, and the heat insulating component 1321 can be made of heat resistant plastic. However, it is not limited to this embodiment. It depends on practical demands. For example, in another embodiment, the two sides of the heat conducting component 1323 can be connected to the first disposing surface P1 and the third disposing surface P3, and the two sides of the heat reflecting component 1324 can also be connected to the disposing surface P1 and the third disposing surface P3 to contact with the two sides of the heat conducting component 1323.

In contrast to the prior art, the present disclosure utilizes the heat insulating component for isolating the heat conducting component, the heat reflecting component and the metal reinforcing component. Furthermore, the metal reinforcing component with the greater stiffness is installed on the outer side of the heat insulating component. In such a way, it prevents the heat from transferring from the heat conducting component to the heat reflecting component or the metal reinforcing component, which reduces heat loss effectively and maintains temperature. Therefore, the fusing device can achieve a purpose of reducing electricity consumption and enhancing printing quality.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A fusing device adapted for fusing toners onto a printing media, the fusing device comprising:

a driving roller for driving the printing media to move along a moving direction; and a fusing unit comprising:

a heat insulating component, an accommodating space being formed in the heat insulating component, an opening being formed on a side of the heat insulating component near the driving roller and communicated with the accommodating space;

a heat generating component located inside the accommodating space and for generating heat;

a heat conducting component connected to the heat insulating component and covering the opening;

a heat reflecting component connected to the heat insulating component, the heat reflecting component being located inside the accommodating space and on a side of the heat generating component away from the heat conducting component for reflecting the heat generated by the heat generating component to the heat conducting component;

a metal reinforcing component installed on an outer side of the heat insulating component, a stiffness of the metal reinforcing component being greater than a stiffness of the heat insulating component; and a fusing component movably enclosing the heat conducting component, the heat insulating component and the metal reinforcing component, the heat conducting component conducting the heat to the fusing component, and the fusing component contacting with the printing media to fuse the toners onto the printing media by heating when the driving roller drives the printing media to move along the moving direction.

2. The fusing device of claim 1, wherein the heat conducting component and the metal reinforcing component are separated from each other.

3. The fusing device of claim 1, wherein the metal reinforcing component is disposed on a side of the heat insulating component away from the driving roller.

4. The fusing device of claim 3, wherein a cross section of the metal reinforcing component is substantially formed in a U shape, and two sides of the metal reinforcing component are fixed on the side of the heat insulating component away from the driving roller.

5. The fusing device of claim 1, wherein the heat reflecting component and the heat conducting component are separated from each other.

6. The fusing device of claim 5, wherein a cross section of the heat insulating component is substantially formed in a U shape, a first step-shaped structure is formed on a side of the heat insulating component near the opening, the first step-shaped structure comprises a first disposing surface and a second disposing surface, and a side of the heat conducting component and a side of the heat reflecting component are connected to the first disposing surface and the second disposing surface respectively and do not contact with each other.

7. The fusing device of claim 6, wherein a second step-shaped structure is formed on another side of the heat insulating component near the opening, the second step-shaped structure comprises a third disposing surface and a fourth disposing surface, and another side of the heat conducting component and another side of the heat reflecting component are connected to the third disposing surface and the fourth disposing surface respectively and do not contact with each other.

8. The fusing device of claim 1, wherein the heat reflecting component is a bent mirror aluminum plate.

9. The fusing device of claim 1, wherein the heat insulating component is made of heat resistant plastic.

10. A printing apparatus comprising:

a toner cartridge storing toners;

a photoconductive drum for transferring the toners from the toner cartridge to a printing media; and a fusing device for fusing the toners onto the printing media, the fusing device comprising:

a driving roller for driving the printing media to move along a moving direction; and a fusing unit comprising:

a heat insulating component, an accommodating space being formed in the heat insulating component, an opening being formed on a side of the heat insulating component near the driving roller and communicated with the accommodating space;

a heat generating component located inside the accommodating space and for generating heat;

a heat conducting component connected to the heat insulating component and covering the opening;

a heat reflecting component connected to the heat insulating component, the heat reflecting component being located inside the accommodating space and on a side of the heat generating component away from the heat conducting component for reflecting the heat generated by the heat generating component to the heat conducting component;

a metal reinforcing component installed on an outer side of the heat insulating component, a stiffness of the metal reinforcing component being greater than a stiffness of the heat insulating component; and a fusing component movably enclosing the heat conducting component, the heat insulating component and the metal reinforcing component, the heat conducting component conducting the heat to the fusing component, and the fusing component contacting with the printing media to fuse the toners onto the printing media by heating when the driving roller drives the printing media to move along the moving direction.

11. The printing apparatus of claim 10, wherein the heat conducting component and the metal reinforcing component are separated from each other.

12. The printing apparatus of claim 10, wherein the metal reinforcing component is disposed on a side of the heat insulating component away from the driving roller.

13. The printing apparatus of claim 12, wherein a cross section of the metal reinforcing component is substantially formed in a U shape, and two sides of the metal reinforcing component are fixed on the side of the heat insulating component away from the driving roller.

14. The printing apparatus of claim 10, wherein the heat reflecting component and the heat conducting component are separated from each other.

15. The printing apparatus of claim 14, wherein a cross section of the heat insulating component is substantially formed in a U shape, a first step-shaped structure is formed on a side of the heat insulating component near the opening, the first step-shaped structure comprises a first disposing surface and a second disposing surface, and a side of the heat conducting component and a side of the heat reflecting component are connected to the first disposing surface and the second disposing surface respectively and do not contact with each other.

16. The printing apparatus of claim 15, wherein a second step-shaped structure is formed on another side of the heat insulating component near the opening, the second step-shaped structure comprises a third disposing surface and a fourth disposing surface, and another side of the heat conducting component and another side of the heat reflecting component are connected to the third disposing surface and the fourth disposing surface respectively and do not contact with each other.

17. The printing apparatus of claim 10, wherein the heat reflecting component is a bent mirror aluminum plate.

18. The printing apparatus of claim 10, wherein the heat insulating component is made of heat resistant plastic.

* * * * *